US011926502B2

(12) United States Patent
Adachi et al.

(10) Patent No.: US 11,926,502 B2
(45) Date of Patent: Mar. 12, 2024

(54) TRANSPORT DEVICE

(71) Applicant: Panasonic Intellectual Property Management Co., Ltd., Osaka (JP)

(72) Inventors: Kentarou Adachi, Osaka (JP); Takafumi Kaneda, Hyogo (JP); Hayase Minoura, Osaka (JP); Masaki Takahashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/373,589

(22) Filed: Jul. 12, 2021

(65) Prior Publication Data

US 2022/0033208 A1 Feb. 3, 2022

(30) Foreign Application Priority Data

Jul. 28, 2020 (JP) ..... 2020-127478

(51) Int. Cl.
*B65H 5/22* (2006.01)
*B65H 29/24* (2006.01)
*B65H 29/32* (2006.01)

(52) U.S. Cl.
CPC ..... *B65H 5/224* (2013.01); *B65H 29/242* (2013.01); *B65H 29/32* (2013.01); *B65H 2301/44735* (2013.01); *B65H 2406/3124* (2013.01); *B65H 2406/323* (2013.01); *B65H 2406/363* (2013.01); *B65H 2406/41* (2013.01)

(58) Field of Classification Search
CPC ..... B65H 5/224; B65H 2406/3124; B65H 2406/323; B65H 2406/363; B65H 29/242; B65H 2301/44735; B65H 2301/44734; B65H 29/32; B65G 57/04
See application file for complete search history.

(56) References Cited

U.S. PATENT DOCUMENTS 6,254,081 B1 * 7/2001 Rasmussen ..... B41J 13/226 271/96
2005/0248081 A1 * 11/2005 Gaissert ..... B65H 9/163 271/251
2020/0086664 A1 * 3/2020 Verheijen ..... B41J 3/4078

FOREIGN PATENT DOCUMENTS

JP 63267654 A * 11/1988
JP 08157098 A * 6/1996
(Continued)

*Primary Examiner* — Luis A Gonzalez
(74) *Attorney, Agent, or Firm* — Wenderoth, Lind & Ponack, L.L.P.

(57) ABSTRACT

A transport device transports an individualized sheet-shaped workpiece. The transport device includes: an annular transport belt having a first surface and a second surface opposite to the first surface and having a plurality of suction holes extending between the first surface and the second surface; first and second decompression chambers arranged along a moving direction of the transport belt; and a vacuum degree adjusting mechanism provided in the first decompression chamber and adjusting a vacuum degree in the first decompression chamber. The first and second decompression chambers each abut against the second surface, and each suction the workpiece through at least one of the plurality of suction holes toward the first surface such that the transport belt is capable of transporting the workpiece in the moving direction in a suspended state from the first surface.

3 Claims, 12 Drawing Sheets

(56) References Cited

FOREIGN PATENT DOCUMENTS

| | | | | |
|---|---|---|---|---|
| JP | 2001048393 | A | * | 2/2001 |
| JP | 2016-035915 | | | 3/2016 |

* cited by examiner

TRANSPORT DEVICE

BACKGROUND

1. Technical Field

The present disclosure relates to a transport device for transporting an individualized sheet-shaped workpiece with a transport belt.

2. Description of the Related Art

As a product manufacturing process, there is a production line in which a workpiece is moved between a plurality of manufacturing devices by using a transport device, and one product is completed through a predetermined process in each manufacturing device.

Japanese Patent Unexamined Publication No. 2016-35915 discloses an annular transport belt provided with a suction hole as transport means of a separator or an electrode plate in a manufacturing device of a battery electrode plate package. As the transport means, a plurality of decompression chambers are arranged along a moving direction of the transport belt, and the separator or the like placed on the transport belt is transported while being suctioned by the decompression chamber through the suction hole. Of the plurality of decompression chambers, the pressure can be set for a predetermined decompression chamber.

SUMMARY

A transport device according to an aspect of the present disclosure transports a workpiece having an individualized sheet shape. The transport device includes: an annular transport belt having a first surface and a second surface opposite to the first surface and having a plurality of suction holes extending between the first surface and the second surface; first and second decompression chambers arranged along a moving direction of the transport belt; and a vacuum degree adjusting mechanism provided in the first decompression chamber and adjusting a vacuum degree in the first decompression chamber. The first and second decompression chambers each abut against the second surface, and each suction the workpiece through at least one of the plurality of suction holes toward the first surface such that the transport belt is capable of transporting the workpiece in the moving direction in a suspended state from the first surface.

DETAILED DESCRIPTIONS

In the transport means disclosed in Japanese Patent Unexamined Publication No. 2016-35915, since the workpiece is placed on the transport belt, the workpiece can be picked up only from above the transport belt. The space below the transport belt is also occupied by the transport means itself. Therefore, it is difficult to freely dispose the manufacturing device, and the transport path is a constraint when deciding the layout of the manufacturing device on the production line.

The present disclosure has been made in view of these points, and a main object thereof is to provide a transport device capable of improving a degree of freedom in layout of a manufacturing device in a production line.

Hereinafter, the exemplary embodiment of the present disclosure will be described in detail based on the drawings. The present disclosure is not limited to the following exemplary embodiments. The present disclosure can be appropriately changed without departing from the range in which the effect of the present disclosure is exhibited.

Figure 1:
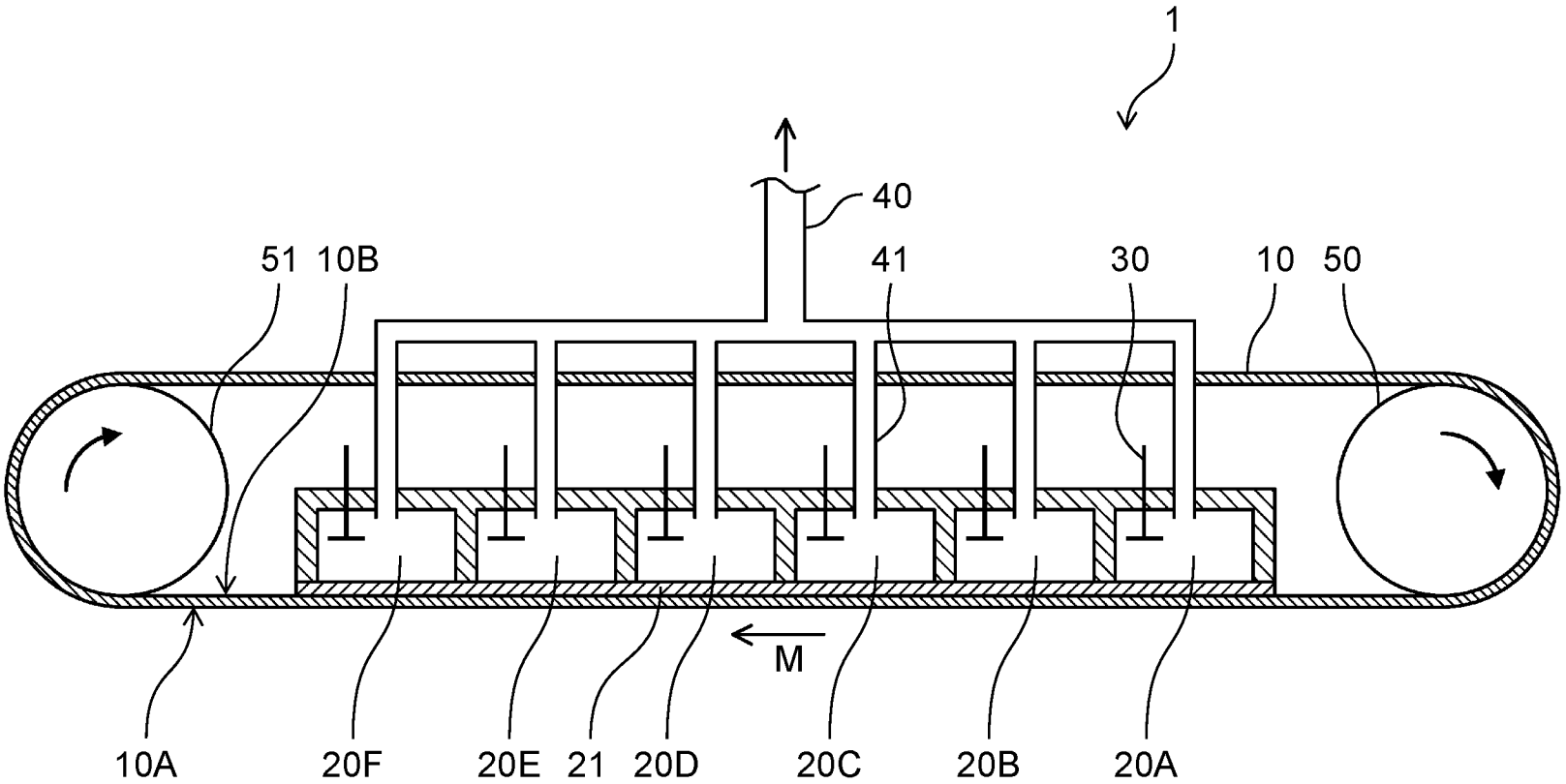
FIG. 1 is a view schematically illustrating a configuration of a transport device according to an exemplary embodiment of the present disclosure.

FIG. 1 is a view schematically illustrating a configuration of a transport device according to an exemplary embodiment of the present disclosure.

Transport device 1 in the exemplary embodiment transports the individualized sheet-shaped workpiece with transport belt 10. Here, the workpiece is used for parts of the product or the like in the manufacturing process of the product, and the type thereof does not matter.

As illustrated in FIG. 1, transport device 1 includes annular transport belt 10 having a plurality of suction holes (not illustrated) and a plurality of decompression chambers 20A to 20F arranged along moving direction M of transport belt 10. For example, decompression chamber 20D is a first decompression chamber, and decompression chamber 20F is a second decompression chamber. Transport belt 10 is circulated and driven by the rotation of the pair of sprockets 50 and 51.

Transport belt 10 has surface 10A (first surface) for sucking a workpiece (not illustrated) and surface 10B (second surface) opposite to surface 10A. Each suction hole formed in transport belt 10 extends between surfaces 10A and 10B. Decompression chambers 20A to 20F are arranged to abut against surface 10B. The bottom of decompression chambers 20A to 20F that abuts against transport belt 10 is made of resin member 21.

Decompression chambers 20A to 20F are each connected to exhaust pipe 40 via pipe 41, and are depressurized by a vacuum pump (not illustrated). In decompression chambers 20A to 20F, vacuum degree adjusting mechanism 30 for adjusting the vacuum degree in decompression chambers 20A to 20F is provided. Here, the type of vacuum degree adjusting mechanism 30 is not particularly limited, but for example, a valve (specifically, a vacuum regulator, a relief valve, and the like) can be used.

Figure 2A:
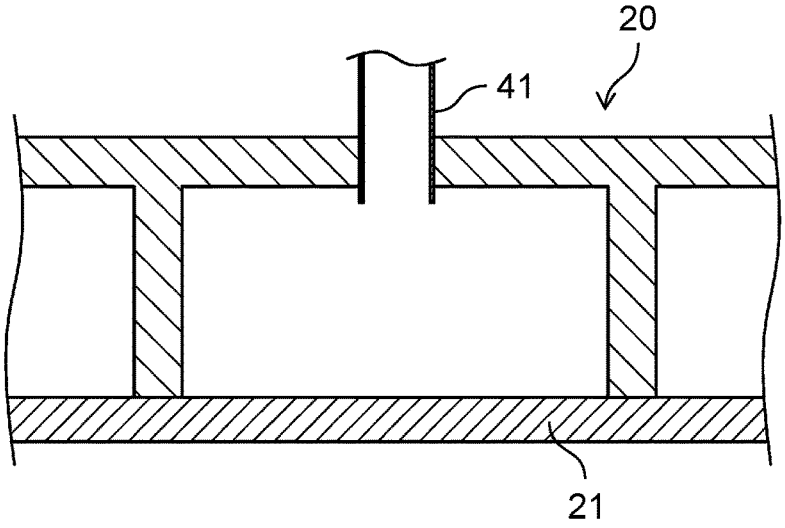
FIG. 2A is a sectional view schematically illustrating a configuration of a decompression chamber.
Figure 2B:
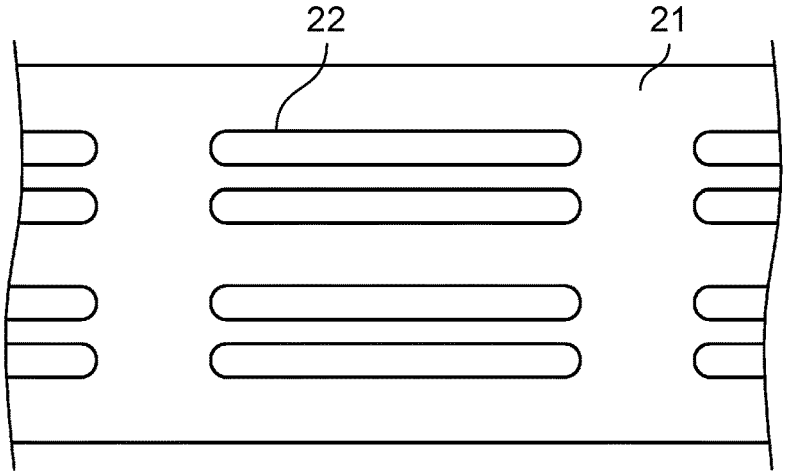
FIG. 2B is a bottom view schematically illustrating the configuration of the decompression chamber.

FIG. 2A is a sectional view schematically illustrating a configuration of decompression chamber 20. FIG. 2B is a bottom view schematically illustrating a configuration of decompression chamber 20.

As illustrated in FIG. 2A, the bottom of decompression chamber 20 that abuts against transport belt 10 is made of resin member 21. As illustrated in FIG. 2B, resin member 21 has a plurality of vent holes 22. The shape and number of vent holes 22 are not particularly limited. The type of resin member 21 is not particularly limited, but for example, a polyamide resin, polyethylene terephthalate, or the like can be used. By making the bottom of decompression chamber 20 that abuts against transport belt 10 with resin member 21, the frictional resistance between decompression chamber 20 and the transport belt when transport belt 10 moves can be reduced.

Figure 3:
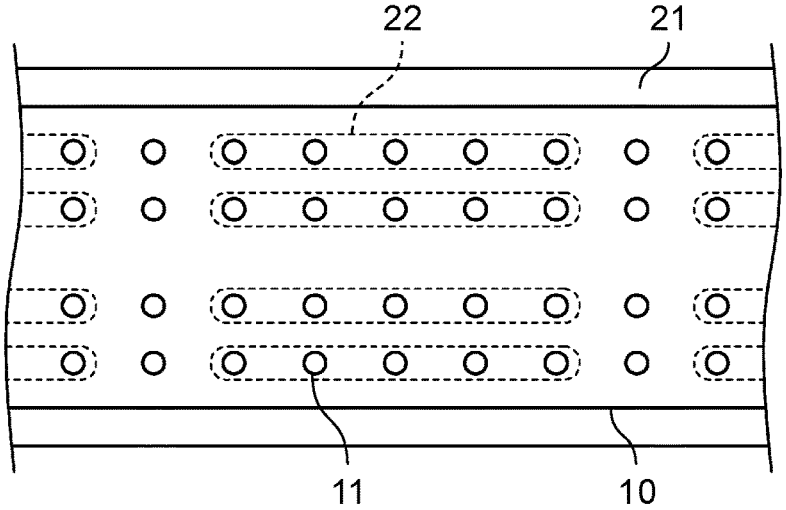
FIG. 3 is a view illustrating a state where the decompression chamber is disposed to abut against the transport belt.

FIG. 3 is a view illustrating a state where decompression chamber 20 is disposed to abut against transport belt 10 when viewed from below.

As illustrated in FIG. 3, vent holes 22 provided in resin member 21 and suction holes 11 provided in transport belt 10 are arranged at positions that overlap each other. Accordingly, the workpiece is suctioned by decompression chamber 20 through suction holes 11 and vent holes 22 and is sucked to transport belt 10. Decompression chambers 20A to 20F abut against surface 10B of transport belt 10, respectively. Furthermore, decompression chambers 20A to 20F each suction the workpiece through at least one of the plurality of suction holes 11 toward surface 10A of transport belt 10. Decompression chambers 20A to 20F allow transport belt 10 to transport the workpiece from surface 10A in the moving direction in a suspended state. Suction holes 11 are formed at equal intervals along the moving direction of transport belt 10, and vent holes 22 are formed elongated along the moving direction of transport belt 10 so as to include the plurality of suction holes 11. Accordingly, even when the transport belt moves, the workpiece is continuously suctioned by decompression chamber 20 through suction holes 11 and vent holes 22 and is sucked to transport belt 10.

Next, a method of transporting the workpiece using transport device 1 will be described with reference to FIGS. 4A to 4D and 5A to 5D.

Figure 4A:
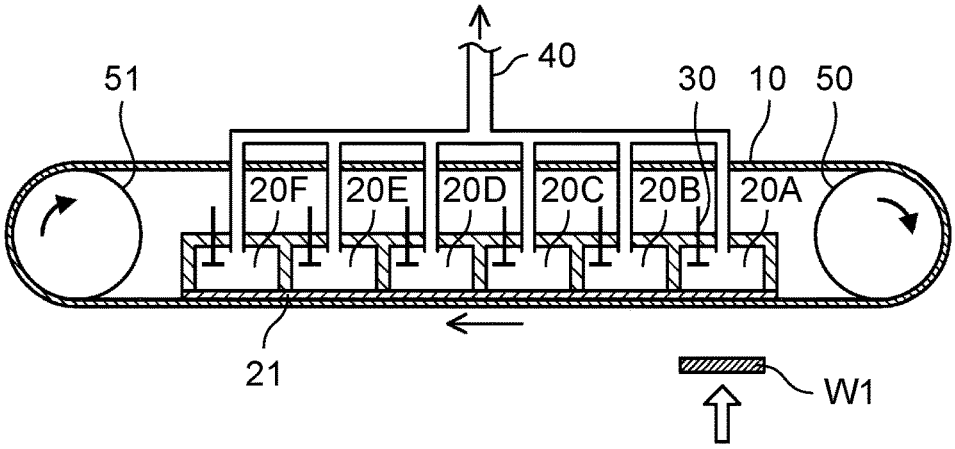
FIG. 4A is a view describing a method of transporting a workpiece using the transport device.
Figure 4B:
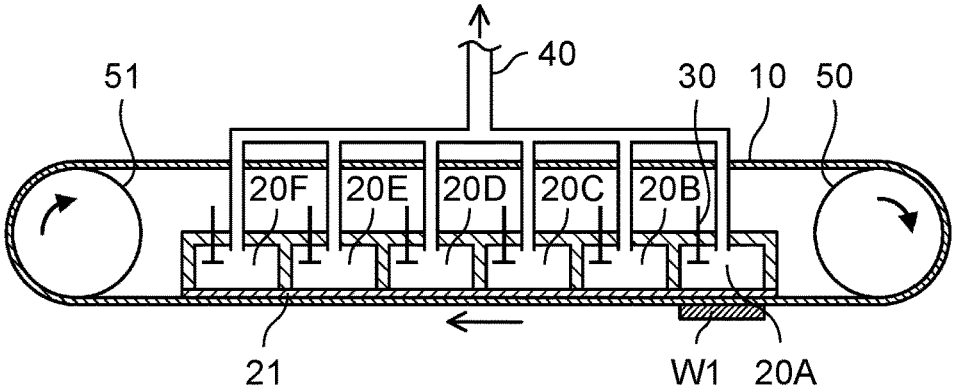
FIG. 4B is a view describing the method of transporting the workpiece using the transport device.
Figure 4C:
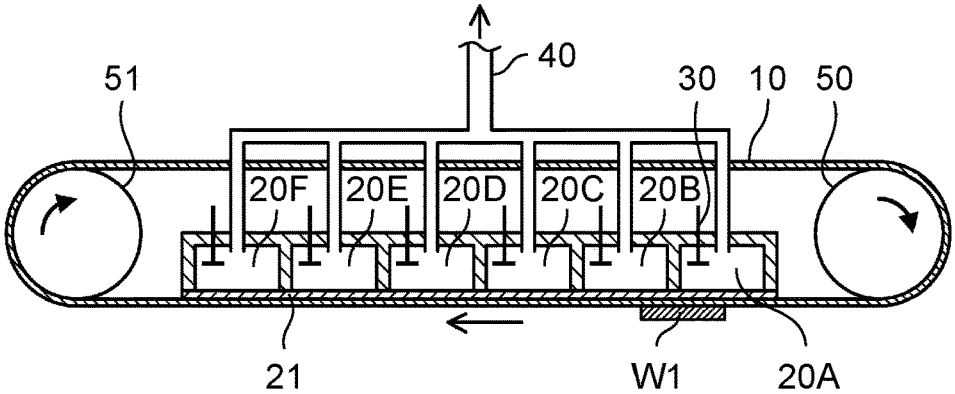
FIG. 4C is a view describing the method of transporting the workpiece using the transport device.

As illustrated in FIG. 4A, all decompression chambers 20A to 20F are exhausted by exhaust pipe 40 to be in a depressurized state, and in a state where transport belt 10 is moved, workpiece W1 is sucked to transport belt 10 at a position corresponding to decompression chamber 20A by using a jig (not illustrated) (FIG. 4B). Workpiece W1 sucked to transport belt 10 is transported to adjacent decompression chamber 20B by the movement of transport belt 10 (FIG. 4C).

Figure 4D:
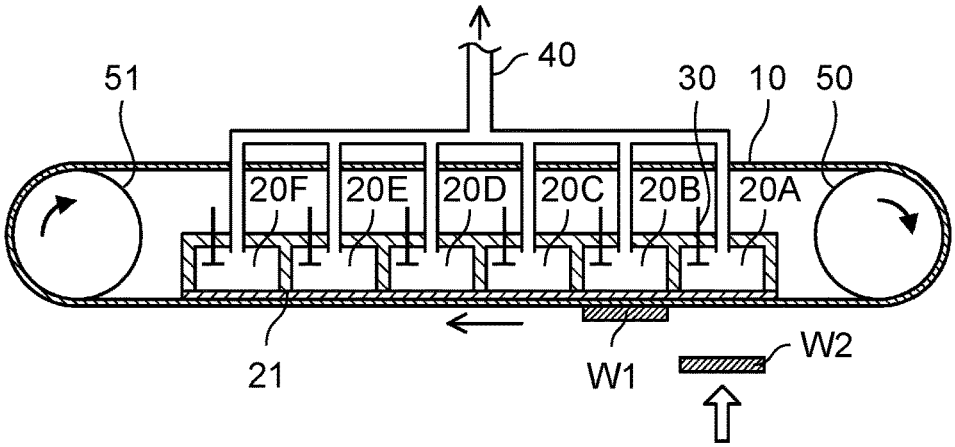
FIG. 4D is a view describing the method of transporting the workpiece using the transport device.
Figure 5A:
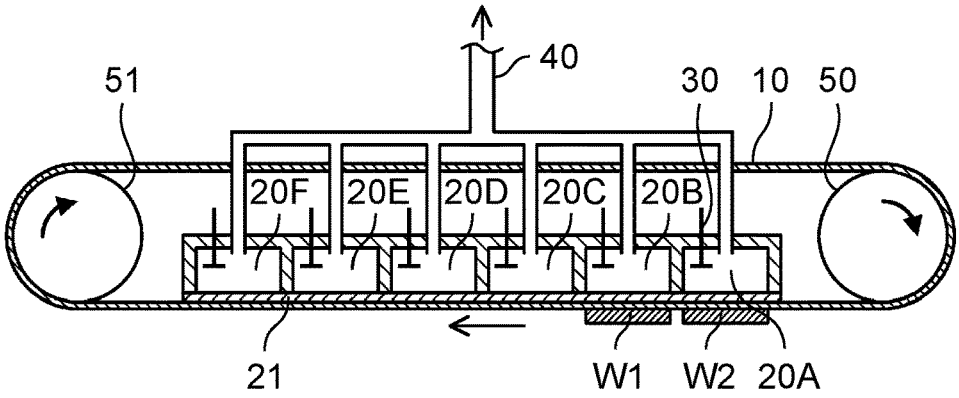
FIG. 5A is a view describing the method of transporting the workpiece using the transport device.
Figure 5B:
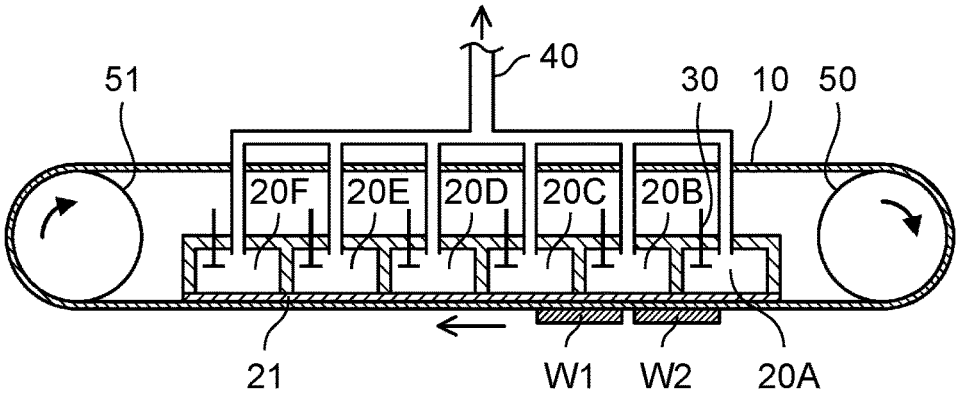
FIG. 5B is a view describing the method of transporting the workpiece using the transport device.

Next, as illustrated in FIG. 4D, at the timing when workpiece W1 is transported to the position of decompression chamber 20B, next workpiece W2 is sucked to transport belt 10 at the position corresponding to decompression chamber 20A (FIG. 5A). Workpieces W1 and W2 sucked to transport belt 10 are respectively transported to adjacent decompression chambers 20C and 20B by the movement of transport belt 10 (FIG. 5B).

Figure 5C:
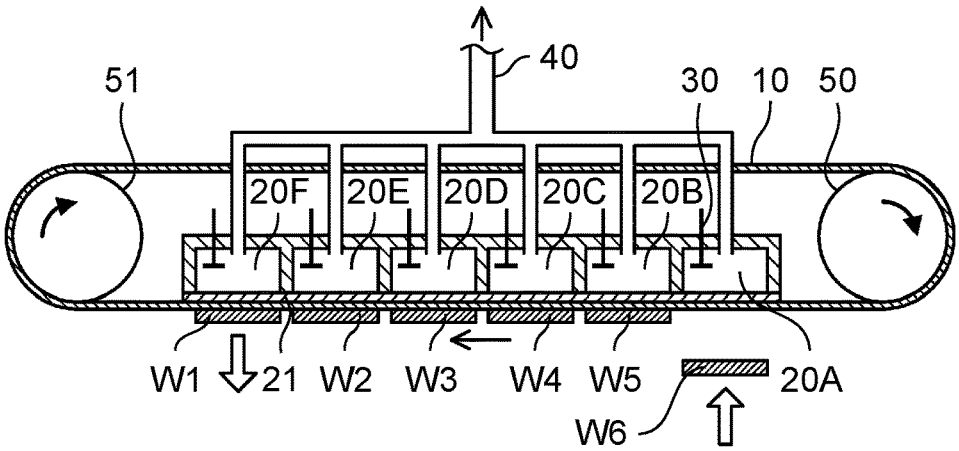
FIG. 5C is a view describing the method of transporting the workpiece using the transport device.
Figure 5D:
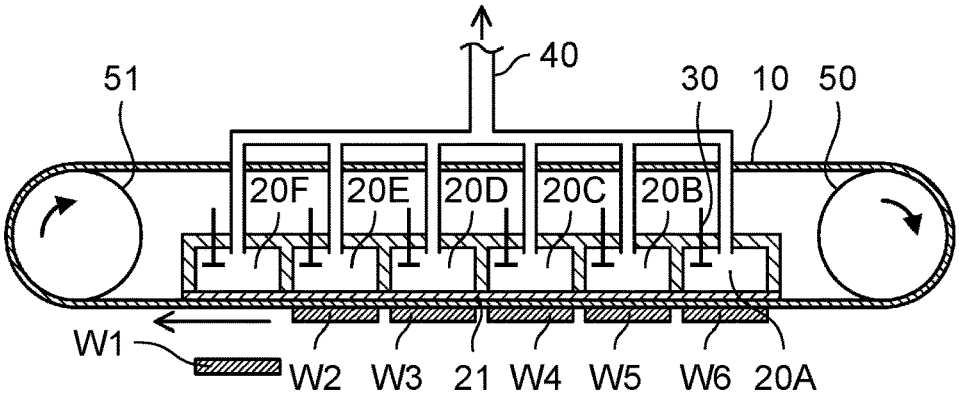
FIG. 5D is a view describing the method of transporting the workpiece using the transport device.

In the same procedure, while transporting workpieces W1 and W2, workpieces W3 to W6 are sequentially sucked to transport belt 10 at a position corresponding to decompression chamber 20A (FIG. 5C). Accordingly, workpieces W1 to W6 are sucked to all decompression chambers 20A to 20F. Workpiece W1 transported to the position of decompression chamber 20F is disengaged from transport belt 10 by lowering the vacuum degree (increasing the pressure) in decompression chamber 20F (FIG. 5D).

In transport device 1 of the exemplary embodiment, workpiece W is suctioned by decompression chamber 20 and is sucked to transport belt 10 in a suspended state and transported. Therefore, unlike the method in which the workpiece is placed on the transport belt and transported, a suction force exceeding the weight of workpiece W is required such that workpiece W does not fall.

Meanwhile, when the suction force becomes extremely large, transport belt 10 and a slider of resin member 21 provided at the bottom of the decompression chamber 20 come into close contact with each other to increase the frictional resistance, and as a result, transport belt 10 does not move. Therefore, it is necessary to adjust the vacuum degree in decompression chamber 20 so as to realize the suction force equal to or greater than the weight of workpiece W and to have a frictional resistance that does not interfere with the operation of transport belt 10.

In transport device 1 of the exemplary embodiment, individualized sheet-shaped workpiece W is continuously sucked to transport belt 10 and transported. At this time, decompression chambers 20A to 20F are exhausted by a vacuum pump through exhaust pipe 40 and are in a depressurized state. Unlike a case of transporting a continuous workpiece, in a case of transporting individualized workpiece W, when workpiece W is sucked to decompression chamber 20, when workpiece W is continuously transported, or when workpiece W is disengaged from decompression chamber 20, the vacuum degree in decompression chamber 20 fluctuates greatly.

The fluctuation in the vacuum degree in decompression chamber 20A positioned at the head will be described with reference to FIGS. 6A, 6B, 7A, 7B, and 8.

Figure 6A:
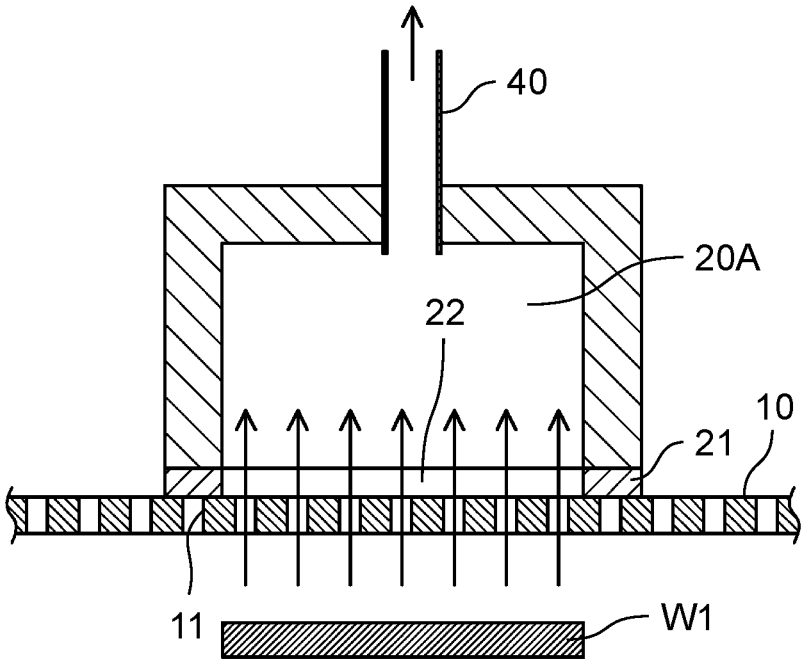
FIG. 6A is a view describing fluctuation in a vacuum degree in the decompression chamber positioned at the head.

FIG. 6A is a view illustrating a state before workpiece W1 is sucked to decompression chamber 20A. In this case, all suction holes 11 of transport belt 10 are open. Therefore, air flows into decompression chamber 20A, which has a negative pressure, from the atmosphere, and the vacuum degree in decompression chamber 20A decreases (the pressure increases).

Figure 6B:
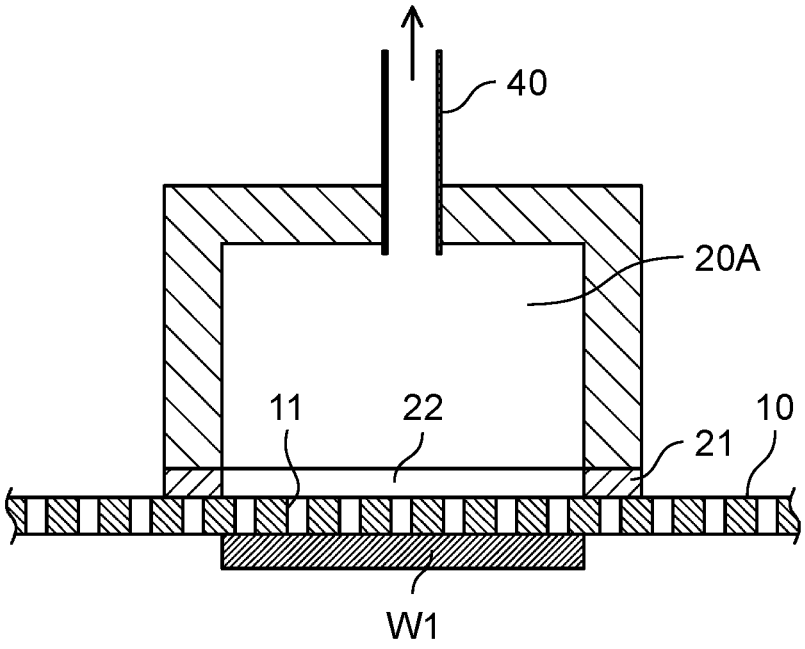
FIG. 6B is a view describing fluctuation in the vacuum degree in the decompression chamber positioned at the head.

Next, as illustrated in FIG. 6B, when workpiece W1 is sucked to decompression chamber 20A, all suction holes 11 of transport belt 10 are closed, and thus, the air inflow disappears and the vacuum degree in decompression chamber 20A increases (the pressure decreases).

Figure 7A:
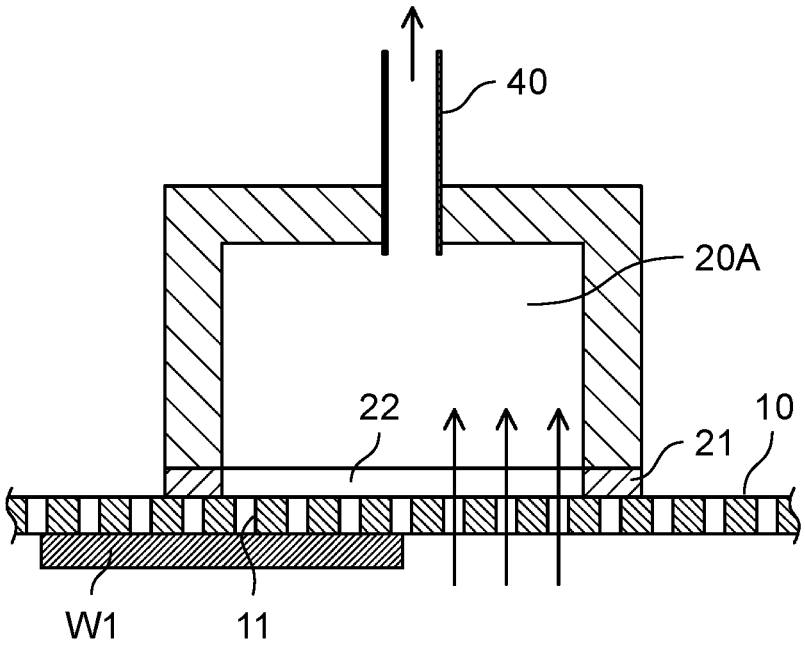
FIG. 7A is a view describing fluctuation in the vacuum degree in the decompression chamber positioned at the head.
Figure 7B:
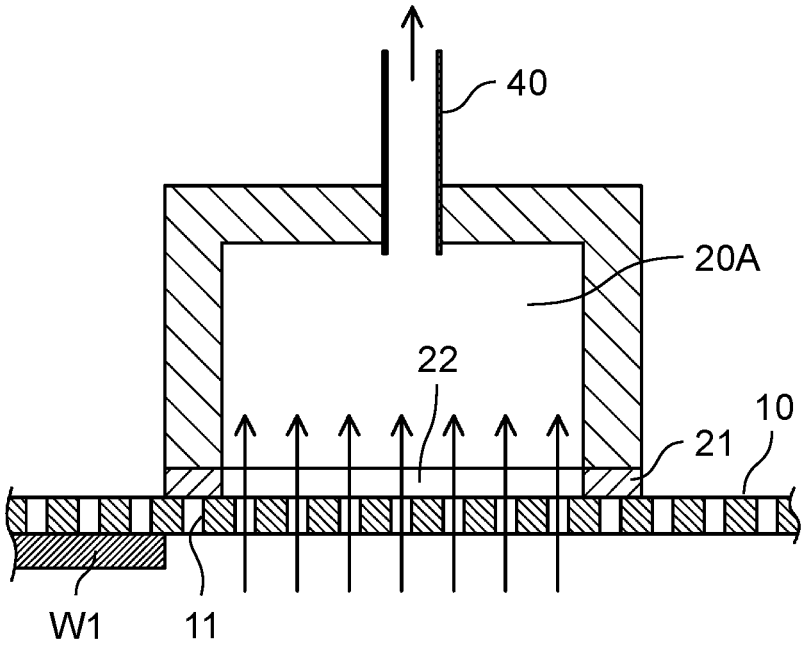
FIG. 7B is a view describing fluctuation in the vacuum degree in the decompression chamber positioned at the head.

Next, as illustrated in FIG. 7A, as workpiece W1 sucked to transport belt 10 moves toward the adjacent decompression chamber, the number of open suction holes 11 gradually increases. Therefore, the air inflow gradually increases, and the vacuum degree in decompression chamber 20A gradually decreases. As illustrated in FIG. 7B, when all suction holes 11 are open, a state illustrated in FIG. 6A is obtained again.

Even when next workpiece W2 is sucked to decompression chamber 20A and workpiece W2 sucked to transport belt 10 moves toward the adjacent decompression chamber, the same fluctuation in the vacuum degree occurs. In this manner, the vacuum degree in decompression chamber 20A fluctuates periodically as illustrated in FIG. 8.

In transport device 1 of the exemplary embodiment, individualized workpiece W is sucked to transport belt 10 in a suspended state and transported. Therefore, when the vacuum degree in decompression chamber 20 is extremely low, the suction force is insufficient and workpiece W falls. When the vacuum degree is extremely high, the frictional resistance between transport belt 10 and resin member 21 provided at the bottom of decompression chamber 20 increases, and the operation of transport belt 10 is hindered.

Figure 8:
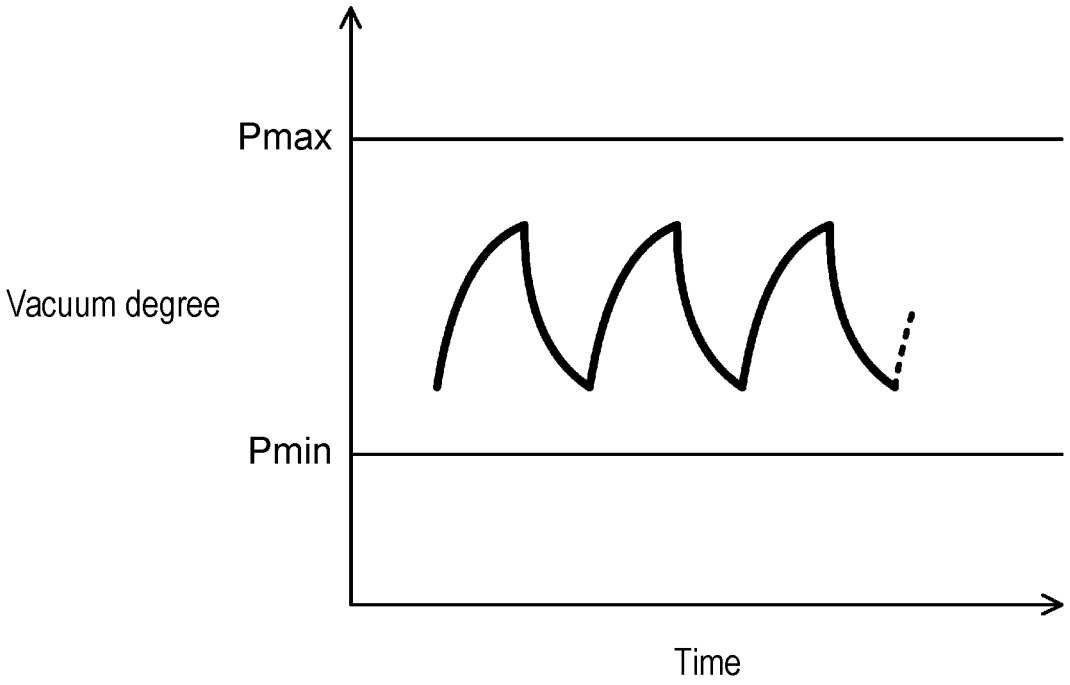
FIG. 8 is a graph illustrating fluctuation in the vacuum degree in the decompression chamber positioned at the head.

Therefore, as illustrated in FIG. 8, it is necessary to control the vacuum degree in decompression chamber 20A so as to be higher than lower limit Pmin at which workpiece W does not fall and lower than upper limit Pmax at which the operation of transport belt 10 is not hindered.

As described above, in transport device 1 of the exemplary embodiment, since individualized workpiece W is transported in a suspended state, unlike a case where the continuous workpiece is transported in a suspended state, the vacuum degree in decompression chamber 20A fluctuates greatly. Therefore, in the exemplary embodiment, as illustrated in FIG. 1, by providing vacuum degree adjusting mechanism 30 for adjusting the vacuum degree in decompression chamber 20A, it is possible to control vacuum degree P in decompression chamber 20A so as to be within an appropriate range (Pmin<P<Pmax).

The periodic fluctuation in the vacuum degree illustrated in FIG. 8 is qualitatively illustrated, and the actual waveform is determined by various factors such as the exhaust speed of decompression chamber 20A, the responsiveness of vacuum degree adjusting mechanism 30, the moving speed of transport belt 10, the number of suction holes 11, the size of workpiece W1 and the like.

In addition to the above-described factors, the size of Pmin or Pmax is also appropriately determined by the mass of workpiece W1 and the frictional resistance between transport belt 10 and resin member 21.

Next, the fluctuation in the vacuum degree in decompression chamber 20B positioned at the center will be described with reference to FIGS. 9A, 9B, 10A, 10B, and 11.

Figure 9A:
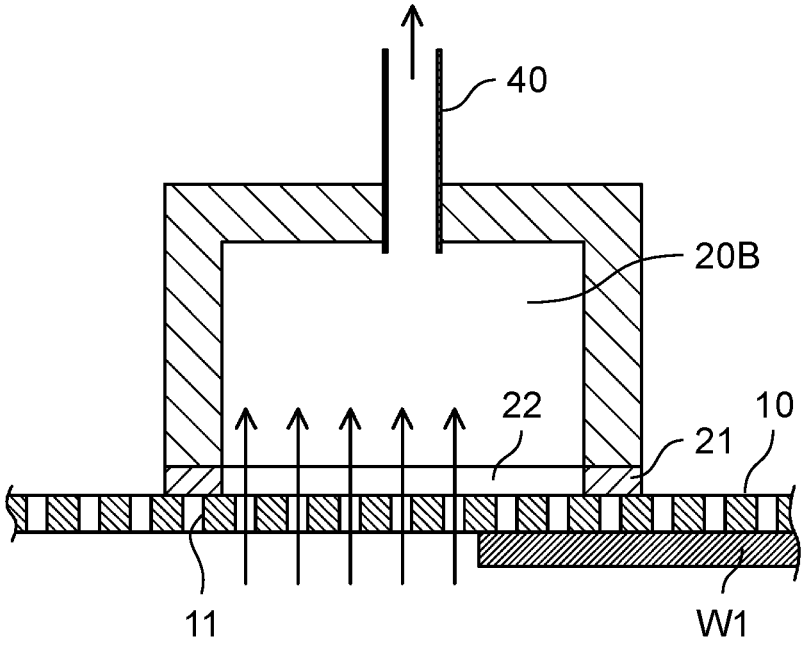
FIG. 9A is a view describing fluctuation in the vacuum degree in the decompression chamber positioned at the center.

FIG. 9A is a view illustrating a state where workpiece W1 sucked to transport belt 10 is moving from decompression chamber 20A at the head toward decompression chamber 20B. At this time, suction holes 11 of transport belt 10 that abuts against decompression chamber 20B are gradually closed from the fully open state. Therefore, the vacuum degree in decompression chamber 20B gradually increases (the pressure decreases).

Figure 9B:
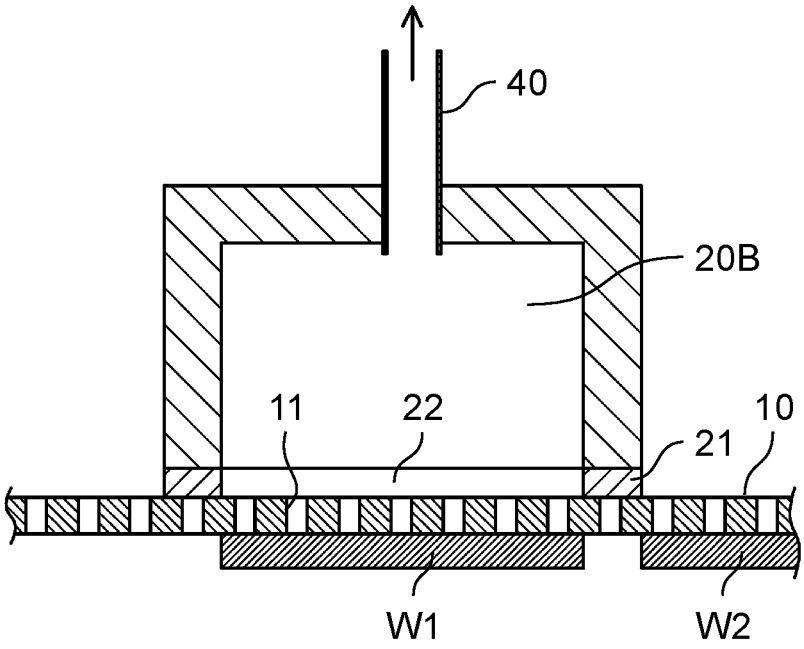
FIG. 9B is a view describing fluctuation in the vacuum degree in the decompression chamber positioned at the center.

As illustrated in FIG. 9B, when workpiece W1 moves to a position facing decompression chamber 20B, all suction holes 11 of transport belt 10 are closed. At this timing, next workpiece W2 is sucked to transport belt 10 at a position corresponding to decompression chamber 20A at the head.

Figure 10A:
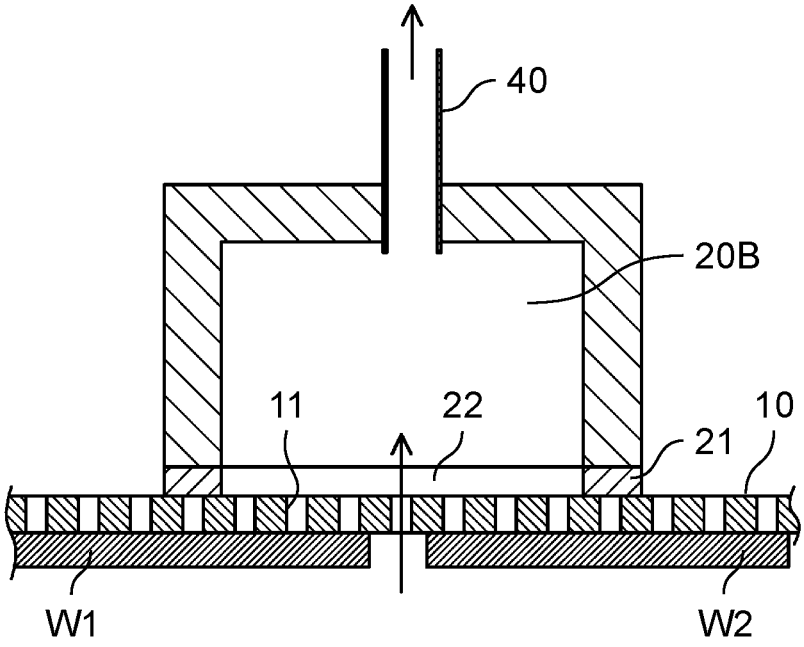
FIG. 10A is a view describing fluctuation in the vacuum degree in the decompression chamber positioned at the center.

Next, as illustrated in FIG. 10A, when workpiece W1 and workpiece W2 sucked to transport belt 10 move toward the adjacent decompression chamber, suction hole 11 between workpiece W1 and workpiece W2 is in an open state. Therefore, since air flows in from suction hole 11, the vacuum degree in decompression chamber 20B decreases (the pressure increases). However, the fluctuation range of the vacuum degree at this time is smaller than the fluctuation range when suction hole 11 shifts from the fully open state to the fully closed state.

Figure 10B:
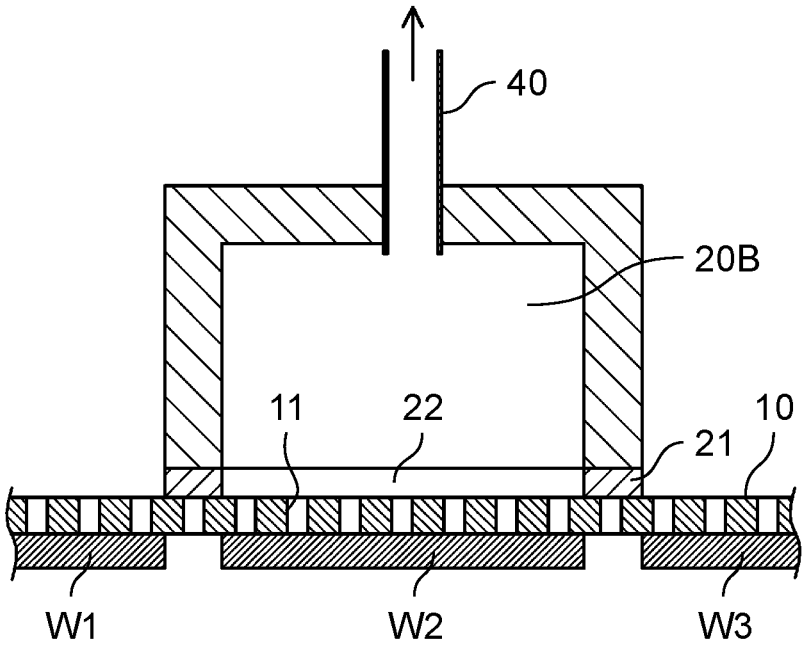
FIG. 10B is a view describing fluctuation in the vacuum degree in the decompression chamber positioned at the center.
Figure 11:
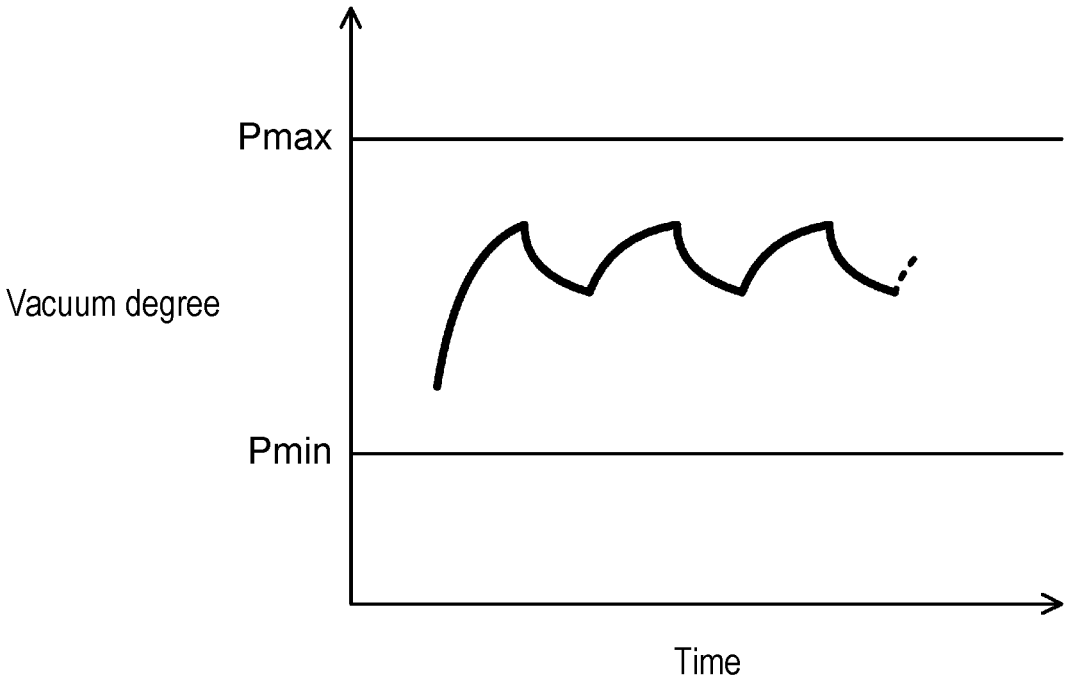
FIG. 11 is a graph illustrating fluctuation in the vacuum degree in the decompression chamber positioned at the center.

As illustrated in FIG. 10B, when workpiece W2 moves to the position facing decompression chamber 20B, all suction holes 11 of transport belt 10 are closed, and a state illustrated in FIG. 9B is obtained again. Even when next workpiece W3 is sucked to transport belt 10 and moves toward decompression chamber 20B, the same fluctuation in the vacuum degree occurs. In this manner, as illustrated in FIG. 11, the vacuum degree in decompression chamber 20B fluctuates greatly at first, and then fluctuates periodically with a fluctuation range smaller than that of the first fluctuation. The fluctuation in the vacuum degree illustrated in FIG. 11 is qualitatively illustrated as in the waveform illustrated in FIG. 8.

In this manner, even in decompression chamber 20B at the center, the vacuum degree fluctuates greatly. However, by providing vacuum degree adjusting mechanism 30 for adjusting the vacuum degree in decompression chamber 20B, vacuum degree P in decompression chamber 20B can be controlled so as to be within the appropriate range (Pmin<P<Pmax).

Even in decompression chamber 20F at the end, the vacuum degree fluctuates similar to decompression chamber 20A at the head or decompression chamber at the center. However, by providing vacuum degree adjusting mechanism 30 for adjusting the vacuum degree in decompression chamber 20F, vacuum degree P in decompression chamber 20F can be controlled so as to be within the appropriate range (Pmin<P<Pmax).

As described above, according to transport device 1 of the exemplary embodiment, even when workpiece W is transported to transport belt 10 in a suspended state, by providing vacuum degree adjusting mechanism 30 for adjusting vacuum degree in each vacuum chamber in decompression chambers 20A to 20F, workpiece W can be stably transported without falling. Accordingly, it is possible to provide a transport device capable of improving the degree of freedom in the layout of the manufacturing device in the production line in which the workpiece is moved between the plurality of manufacturing devices and one product is completed. According to the present disclosure, it is possible to provide a transport device capable of improving the degree of freedom in the layout of the manufacturing device in the production line.

In transport device 1 of the exemplary embodiment, blow pipe 60 for introducing the high-pressure gas into the decompression chamber may be provided in a predetermined decompression chamber among decompression chambers 20A to 20F.

Figure 12A:
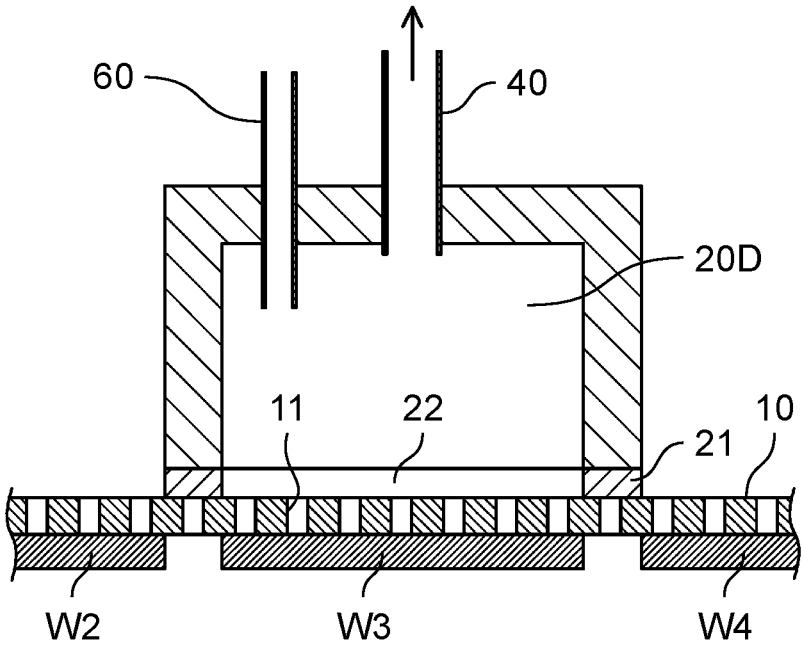
FIG. 12A is a view illustrating an example in which a blow pipe is provided in the decompression chamber.

FIG. 12A is a view illustrating an example in which blow pipe 60 is provided in decompression chamber 20D, and illustrates a state where workpiece W3 has moved to a position facing decompression chamber 20D.

Figure 12B:
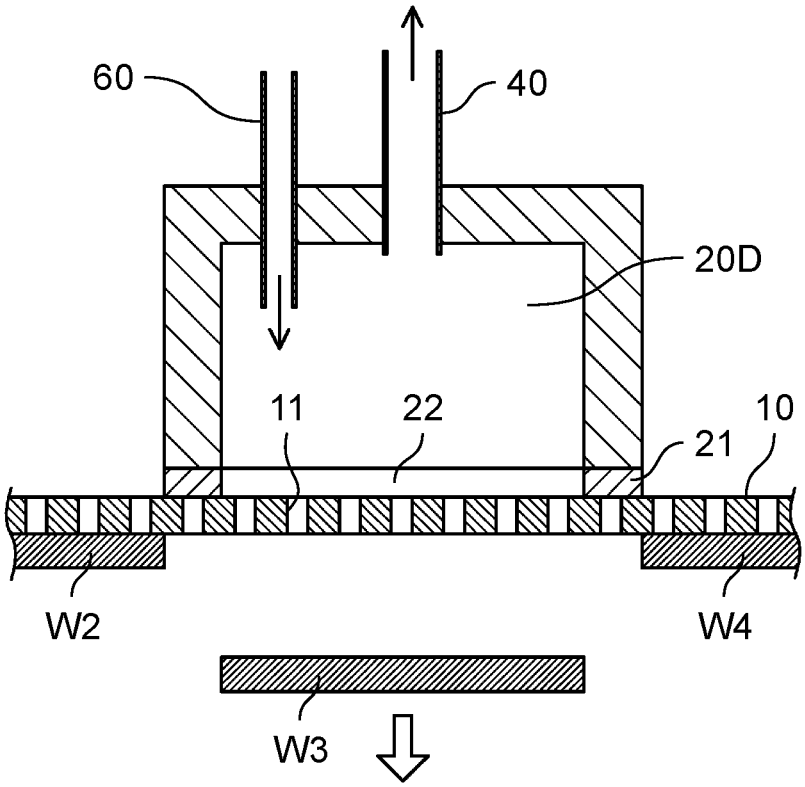
FIG. 12B is a view illustrating an example in which the blow pipe is provided in the decompression chamber.
Figure 13:
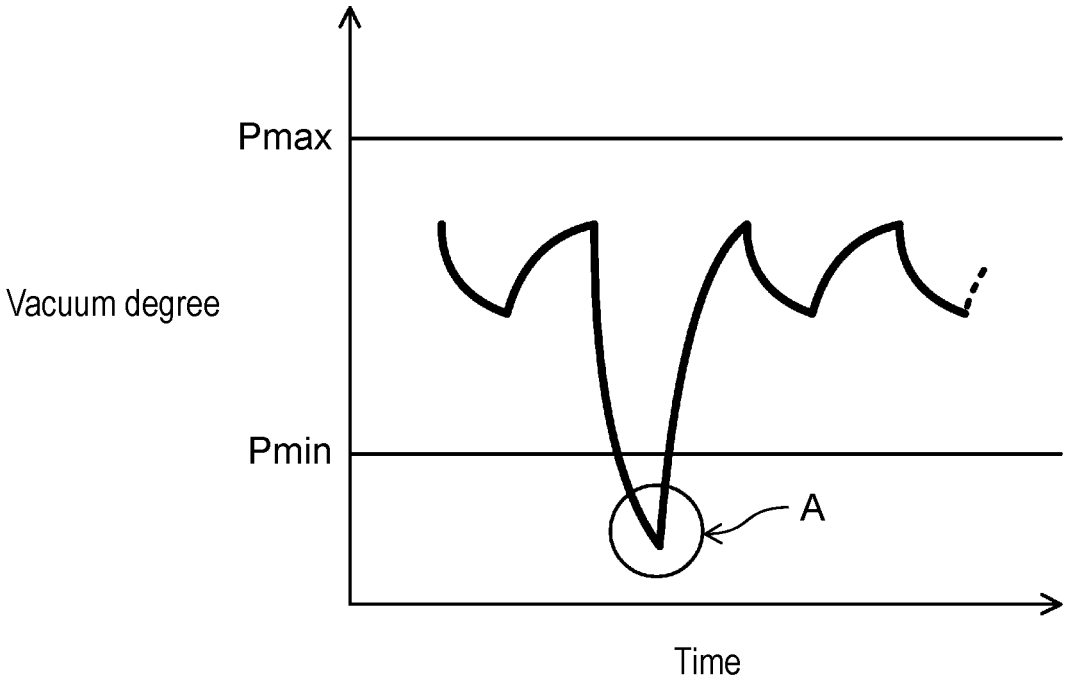
FIG. 13 is a graph illustrating fluctuation in the vacuum degree in the decompression chamber provided with the blow pipe.

At the timing of this state, as illustrated in FIG. 12B, the high-pressure gas is introduced into decompression chamber 20D from blow pipe 60. Accordingly, the vacuum degree in decompression chamber 20D sharply decreases beyond Pmin (arrow A), as illustrated in FIG. 13. Accordingly, the suction force of workpiece W3 cannot support the weight of workpiece W3, and workpiece W3 can be disengaged from transport belt 10.

Even in such a case, since vacuum degree adjusting mechanism 30 (not illustrated) is provided in decompression chamber 20D, after stopping the introduction of the high-pressure gas, the vacuum degree in decompression chamber 20D quickly increases and the vacuum degree can be restored to be within the appropriate range (Pmin<P<Pmax). Accordingly, even when next workpiece W4 moves to the position of decompression chamber 20D, workpiece W4 can be stably transported. For example, when vacuum degree adjusting mechanism 30 is a vacuum regulator, the vacuum degree in decompression chamber 20D can quickly increase by completely opening the throttle. The vacuum degree can be restored to be within the appropriate range (Pmin<P<Pmax) by adjusting the throttle of the vacuum regulator.

Although the present disclosure has been described above with a preferred exemplary embodiment, such a description is not a limitation, and it is needless to say that various modifications can be made. For example, in the above-described exemplary embodiment, transport device 1 is disposed such that transport belt 10 is in the horizontal direction, but transport belt 10 may be disposed in the oblique direction or the perpendicular direction. Accordingly, it is possible to prevent the workpiece sucked to transport belt 10 from being displaced or falling.

In the above-described exemplary embodiment, vent holes 22 are provided in resin member 21, but resin member 21 may be made of a member having air permeability.

In the above-described exemplary embodiment, the bottom of decompression chamber 20 that abuts against transport belt 10 is made of resin member 21, but may be made of other members. A resin member or the like may not be necessarily provided.

In the above-described exemplary embodiment, vacuum degree adjusting mechanism 30 is provided in all decompression chambers 20, but may not be necessarily provided in all decompression chambers 20.

What is claimed is:

1. A transport device that transports a workpiece having an individualized sheet shape, the transport device comprising:

an annular transport belt having a first surface and a second surface opposite to the first surface and having a plurality of suction holes extending between the first surface and the second surface;

first and second decompression chambers arranged along a moving direction of the transport belt; and a vacuum degree adjusting mechanism provided in the first decompression chamber and adjusting a vacuum degree in the first decompression chamber, wherein the vacuum degree adjusting mechanism controls the vacuum degree so as to be within a predetermined range, the first and second decompression chambers each have a bottom that abuts against the transport belt, the bottom is made of a resin member having a vent hole, the vent hole is formed elongated along the moving direction, the vent hole is disposed so as to include at least two suction holes of the plurality of suction holes of the transport belt, and the first and second decompression chambers each abut against the second surface, and each suction the workpiece through at least one of the plurality of suction holes toward the first surface such that the transport belt is capable of transporting the workpiece in the moving direction in a suspended state from the first surface, wherein the predetermined range includes a maximum vacuum value and a minimum vacuum value, each of the maximum vacuum value and the minimum vacuum value is determined by a mass of the workpiece, and each of the maximum vacuum value and the minimum vacuum value is further determined by a frictional resistance between the transport belt and the resin member.

2. The transport device of claim 1, wherein the first and second decompression chambers each suction the workpiece through the at least one of the plurality of suction holes and the vent hole toward the first surface such that the workpiece is sucked to the transport belt.

3. The transport device of claim 1, wherein the first decompression chamber includes a blow pipe for introducing a high-pressure gas into the first decompression chamber.

* * * * *